US008382617B2

(12) United States Patent
Davis

(10) Patent No.: US 8,382,617 B2
(45) **Date of Patent: *Feb. 26, 2013**

(54) MULTI-BLADE BROADHEAD WITH MANUALLY-SHARPENABLE TIP

(76) Inventor: Stephen Scott Davis, Payson, UT (US)

( * ) Notice: Subject to any disclaimer, the term of this patent is extended or adjusted under 35 U.S.C. 154(b) by 1085 days.

This patent is subject to a terminal disclaimer.

(21) Appl. No.: 11/377,133

(22) Filed: Mar. 14, 2006

(65) Prior Publication Data

US 2006/0178238 A1 Aug. 10, 2006

Related U.S. Application Data

(63) Continuation of application No. 10/658,918, filed on Sep. 11, 2003, now Pat. No. 7,011,589.

(51) Int. Cl.
*F42B 6/08* (2006.01)

(52) U.S. Cl. ..... 473/584

(58) Field of Classification Search ..... 473/583, 473/584

See application file for complete search history.

(56) References Cited

U.S. PATENT DOCUMENTS

| | | | | |
|---|---|---|---|---|
| 3,021,138 | A | 2/1962 | Smith | |
| 4,210,330 | A | 7/1980 | Kosbab | |
| 4,410,184 | A | 10/1983 | Anderson | |
| 4,676,512 | A | 6/1987 | Simo | |
| 4,781,386 | A | 11/1988 | Armitage | |
| 5,192,081 | A | 3/1993 | Cooper | |
| RE34,397 | E | 10/1993 | DelMonte et al. | |
| 5,417,440 | A | 5/1995 | Barrie et al. | |
| 5,482,293 | A | 1/1996 | Lekavich | |
| 5,871,410 | A | 2/1999 | Simo et al. | |
| 6,077,180 | A | 6/2000 | Adams, Jr. | |
| 6,428,433 | B1 | 8/2002 | Liechty, II | |
| 6,530,853 | B1 | 3/2003 | Giannetti | |
| 6,626,776 | B2 | 9/2003 | Barrie et al. | |
| 6,749,801 | B1 | 6/2004 | Grace, Jr. et al. | |
| 7,011,589 | B2 * | 3/2006 | Davis | 473/584 |

* cited by examiner

*Primary Examiner* — John Ricci
(74) *Attorney, Agent, or Firm* — Angus C. Fox, III

(57) ABSTRACT

An arrow hunting broadhead has a main body fabricated from high-strength steel, and multiple laminar carbon steel blades which install within the main body. The main body has a manually sharpenable chisel point tip with multiple razor-sharp apices. The main body is equipped with multiple slots, each of which is continuous with one of the apices of the tip and includes a forward-facing recess at the front end of each slot. A laminar carbon steel blade is inserted into each slot and locked in place by a tab on the front of the blade, which fits into the forward-facing recess, and a notch at the rear of the blade, which engages an annular retainer ring that slips over a rear portion of the main body. Each blade forms an extension of its associated apex, with each apex and its associated blade forming a generally straight line.

7 Claims, 5 Drawing Sheets

MULTI-BLADE BROADHEAD WITH MANUALLY-SHARPENABLE TIP

This is a continuation of application Ser. No. 10/658,918, also titled TRI-BLADE BROADHEAD WITH MANUALLY SHARPENABLE TROCAR TIP, that was filed on Sep. 11, 2003, and which issued on Mar. 14, 2006 as U.S. Pat. No. 7,011,589 B2.

BACKGROUND OF THE INVENTION

1. Field of the Invention

This invention relates to arrowheads, and more particularly, to multi-piece arrowhead assemblies known generally as broadheads, which are popular with bow hunters and noted for their long range, deep penetrability, and high lethality.

2. Description of the Prior Art

For thousands of years, archery has played an prominent role in hunting, warfare, and sport. One of the most famous military battles in which archery provided the victors with a decisive advantage occurred at Crecy on Aug. 26, 1346. The English under the command of Edward III, occupied the side of a small hill. On the plain below, outnumbering the English four to one, a disorderly host of French knights on horseback and hired Genoese crossbowmen on foot were arrayed under the command of Philip VI. Edward had all his men dismount because they were armed with the new longbow. Though tired after a long day's march and hampered by crossbow strings that had been loosened by a wetting received in a terrific thundershower, the Genoese were ordered to begin the attack. Though they shot fiercely, they were no match for the more rapid shooting of the English longbowmen, whose shafts "fell so thick that it seemed snow." When the Genoese saw the arrows falling thick among them they threw down their crossbows and ran. King Philip thereupon flew into a rage and ordered his knights to slay the retreating Genoese. As a result, a great number of the mercenaries were killed. Despite being outnumbered by a wide margin, the English army routed the French, killing more than 1,500 of the enemy while losing only 50 men. Flush with victory, the English troops advanced to Calais, which they besieged and eventually captured in 1347.

Archery technology has developed tremendously since its origins thousands of years ago, with more advancements in bow and arrow technology having occurred in the past forty years than in the previous thousands. Though no longer used for warfare, archery remains a challenging sport, with the hunter or archer dependent only upon his or her own strength and skill to hit the target precisely or to produce a clean kill of a game animal. The inherent difficulties associated with the sport are incentive enough for continual improvement of the technology, whether the improvements are in the form of more powerful bows, more accurate projectiles, greater stopping power, or greater lethality.

The technology of archery encompasses both launchers and projectiles. A bow (the launcher) is used to propel an arrow (the projectile) towards a target. A conventional arrow has a shaft, a nock that receives the bow string attached to the trailing end of the shaft, and an arrowhead or point attached to the leading end of the arrow shaft, which aids in penetrating the target. An arrowhead generally has a pointed forward end, and an threaded rearward end that attaches to the leading end of the arrow shaft. Arrowheads come in a variety of different sizes and configurations depending on their intended use. For example, there are specifically designed arrowheads for competitive target shooting, shooting fish, hunting birds or small game animals, and for hunting big game animals. Arrowheads used for bowhunting are generally know as broadheads. Broadheads have cutting blades and kill game animals by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal.

The two most common types of arrowheads used for hunting are fixed-blade arrowheads and blade-opening, or mechanical, arrowheads. Blade-opening arrowheads differ from conventional fixed-blade arrowheads in that the cutting blades are folded up against the arrowhead body in a retracted position so as to reduce aerodynamic drag while the arrow is in flight, rotating to an open, more lethal configuration on impact with the game. The blades of fixed-blade arrowheads are permanently held at a full cutting diameter position at all times.

Both blade-opening and fixed-blade arrowheads have a pointed tip end used for penetrating the game animal. The tip of the arrowhead may be separably attachable to the arrowhead body or may be integral with it. Conventional arrowheads have historically had two basic types of pointed arrowhead tips: bone-crushing chisel-type tips such as the hollow ground trocar tip, and razor-blade-type tips.

A trocar tip is a pointed, three sided tip used to cut or pierce. The three sides of trocar tips are generally hollow ground. The term hollow ground refers to the grinding process used to fabricate the sides of the tip and generally means that the sides are dished-out or substantially concave, as compared to being flat. The hollow ground feature gives the tip better defined cutting edges at the juncture of the sides with each other than the cutting edges at side junctures of tips having flat sides. The hollow ground feature also gives the tip the ability to easily push the substance being penetrated away from the tip. The earliest known use of trocar tips date back to the medieval times where they were used on the leading ends of knights' lances.

The following U.S. Patents are examples of broadheads having bone-crushing chisel-type tips: U.S. Pat. No. 4,676,512 issued Jun. 30, 1987 to Miroslav A. Simo titled ARROWHEAD; U.S. Pat. No. 5,145,186 issued Sep. 8, 1992 to Richard Maleski titled BROADHEAD FOR AN ARROW AND METHOD FOR SECUREMENT; U.S. Pat. No. 5,192,081 issued Mar. 9, 1993 to Gary L. Cooper titled MULTI-BLADE ARROWHEAD; U.S. Pat. No. 5,354,068 issued Oct. 11, 1994 to Richard Maleski titled BROADHEAD FOR AN ARROW AND METHOD OF SECUREMENT; U.S. Pat. No. 5,494,298 issued Feb. 27, 1996 to Richard Maleski; U.S. Pat. No. D385,327 issued Oct. 21, 1997 to Nicholas J. Delmonte titled CUTTING FERRULE BROADHEAD; U.S. Pat. No. 5,871,410 issued Feb. 16, 1999 to Miroslav A. Simo, et al. titled FERRULE WITH IRREGULAR SKIN SURFACE FOR AN ARCHERY BROADHEAD; U.S. Pat. No. 6,077,180 issued Jun. 20, 2000 to Charles C. Adams, Jr. titled ARCHERY BROADHEAD; and U.S. Pat. No. 6,626,776 issued Sep. 30, 2003 to Bruce Barrie, et al. titled EXPANDABLE BROADHEAD WITH MULTIPLE SLIDING BLADES.

The razor blade tips are generally just an extension of the cutting blades of the arrowhead and terminate in a leading pointed apex. The following U.S. Patents are examples of razor-blade-type broadhead tips: U.S. Pat. No. D236,465 issued Aug. 26, 1975 to Wilton Hamilton titled METAL ARROWHEAD; U.S. Pat. No. 4,928,969 issued May 29, 1990 to Wesley S. Nagatori titled ARROWHEAD; U.S. Pat. No. 5,165,697 issued Nov. 24, 1992 to Stanley E. Lauriski et al. titled BROADHEAD ARCHERY HUNTING POINT; U.S. Pat. No. D326,889 issued Jun. 9, 1992 to Larry W. Garoutte titled ARROW BROADHEAD; and U.S. Pat. No. 5,137,282 issued Aug. 11, 1992 to Donald E. Segar, et al. titled PLASTIC MOLDED ARROWHEAD AND METHOD.

Both bone-crushing chisel-type and razor-blade-type arrowhead tips are designed to maximize penetration and therefore provide a more lethal arrowhead by cutting a larger volume of animal tissue. Despite their designs and intent both the bone crushing chisel tips and the razor blade tips fall short of providing optimum penetrating performance. Since the arrowhead razor blade type tips generally have a true cutting edge, or a cutting edge that has a small enough angle between opposing sides so as to make it as sharp as a razor or scalpel blade, they penetrate the best through soft tissues such as skin, muscles, lungs and other internal organs by slicing or cutting. But when a razor blade tip impacts bone the thin cutting blade generally gets sheared or broken-off due to the heavy impact forces delivered to it, and thus leaves a blunt snagging leading end that greatly inhibits penetration and therefore is less lethal in many instances—since arrowheads very commonly impact bone when penetrating game animals. The bone-crushing chisel tips on the other hand split right through heavy bone but lack a truly sharp cutting edge and therefore do not perform as well in penetrating the skin and other soft tissues.

Attempts in the prior art have been made to combine a scalpel sharp cutting edge with bone splitting capabilities into an optimally penetrating arrowhead tip, but these attempts have their own problems as well. For example the introduction of chisel tips with hollow ground sides, such as the three sided trocar tip for arrowhead points helped reduce the angle of the cutting edge between the sides of the tip. But the edges of conventional trocar arrowhead tips and other hollow ground arrowhead tips are still relatively dull and are a far cry from having the fine cutting angle or edge a scalpel or razor blade possesses. Other attempts in the prior art to increase the sharpness of the edges of chisel type arrowhead tips have been made by increasing the curvature of the hollow ground sides. This practice greatly weakens the tip giving it problems similar to those of the razor blade type tips and also provides a tip that does not push the tissue away from the arrowhead optimally.

U.S. Pat. No. 6,306,053 to Victor Jay Liechty, II titled RAZOR-EDGED CUTTING TIP, discloses a broadhead having a tip body with at least one slot for engageable mounting of a cutting tip blade therein. The tip blades provide a razor sharp cutting edge situated near a forward leading end of the corresponding arrowhead. The razor sharp cutting edges of the tip blades in conjunction with the corresponding tip bodies provide cutting tips with sufficient structural integrity to both penetrate soft tissue with ease and crush or split heavy bone.

SUMMARY OF THE INVENTION

An object of the present invention is to provide an arrow broadhead for an arrow having superior penetrating characteristics for both soft tissue and bone. An additional object of the present invention is to provide an arrow broadhead having reduced aerodynamic drag during flight. An additional object of the present invention is to provide an arrow broadhead having reduced susceptability to cross-winds. A further object of the present invention is to provide an arrow broadhead having a main body with a tip that can be manually sharpened without the use of expensive jigs and specialized grinding equipment. Yet another object of the present invention is to provide an arrow broadhead having a main body fabricated from a single piece of high-strength steel. Still another object of the present invention is to provide an arrow broadhead having multiple replaceable laminar blades which may be securely locked into place within the main body.

The present invention provides a broadhead for an arrow having a main body fabricated from high-strength steel, and multiple laminar carbon steel blades which install within the main body. The main body has a manually sharpenable chisel point tip with multiple razor-sharp apices. The main body is equipped with multiple slots, each of which is continuous with one of the apices of the tip and includes a forward-facing recess at the front end of each slot. A laminar carbon steel blade is inserted into each slot and locked in place by a tab on the front of the blade, which fits into the forward-facing recess, and a notch in the end of the blade, which engages an annular retainer ring that slips over a rear portion of the main body. Each blade forms an extension of its associated apex, with each apex and its associated blade forming a generally straight line. The main body is equipped with a threaded extension, by means of which the broadhead may be axially attached to the shaft of an arrow. The annular retainer ring is also held in place by the attachment of the main body to the shaft of an arrow. Each of the laminar blades has a central aperture cut therein which reduces the effect of crosswinds.

DETAILED DESCRIPTION OF THE INVENTION

The invention will now be described with reference to the included drawing figures. It is to be understood that the drawings are not necessarily drawn to scale, and that they are intended to be merely illustrative of the invention and the method of making.

Figure 1:
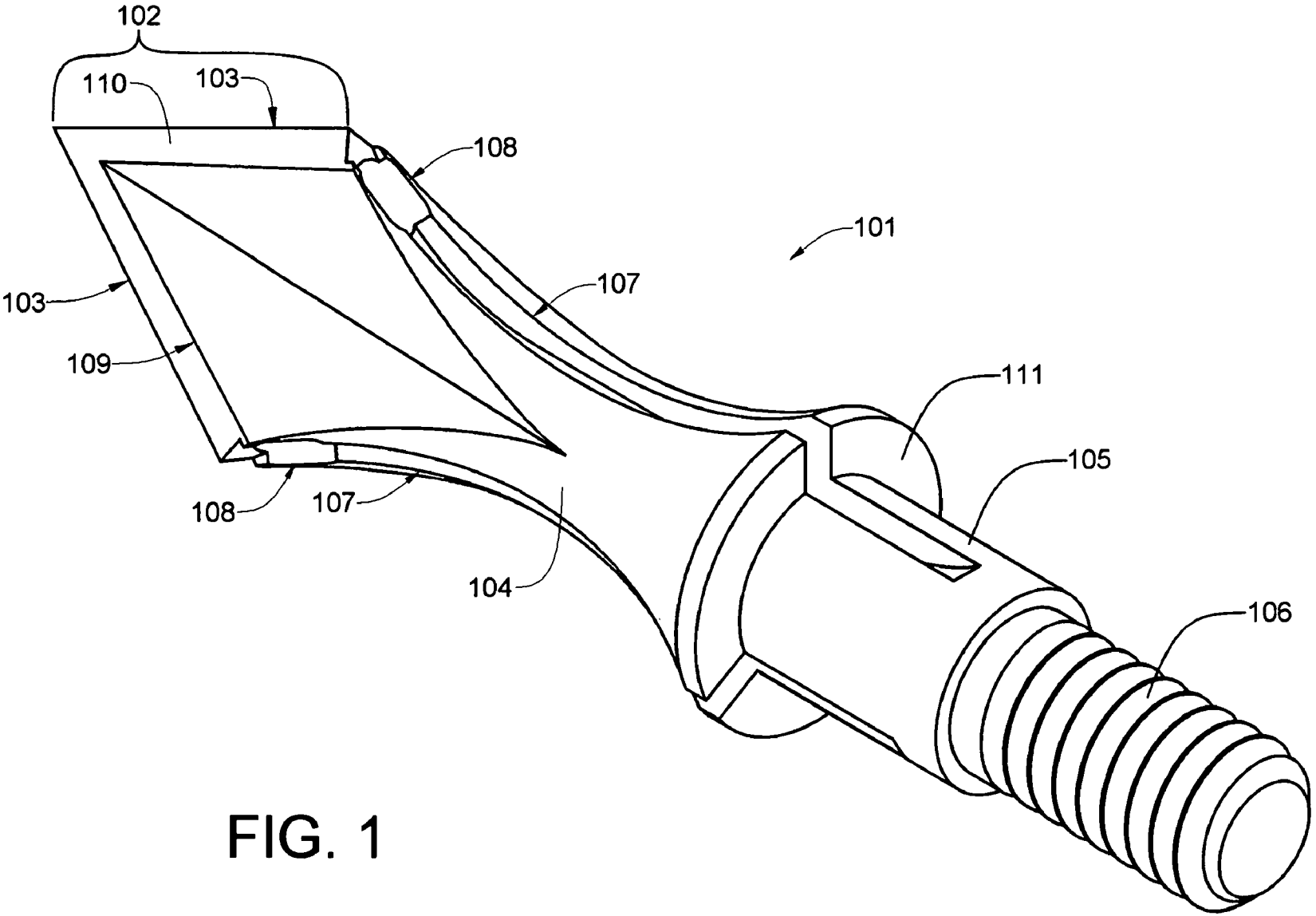
FIG. 1 is an isometric view of the main body of the my new tri-blade arrowhead.

Referring now to FIG. 1, the main body 101 of the new broadhead has a sharpened trocar tip 102 with three intersecting, sharpened straight edges 103 (only two are visible in this view), a generally hour-glass shaped portion 104 continuous with the trocar tip 102, a cylindrical portion 105 having a diameter that is reduced from the maximum diameter of the hour-glass shaped portion 104, and a threaded rear portion 106 that is continuous with the cylindrical portion 105. The generally hour-glass shaped portion 104 is equipped with three blade installation slots 107 (only two of which are visible in this view), each of which is positioned directly behind and in line with a sharpened straight edge 103 of the trocar tip 102. At the frontmost portion of each blade installation slot 107 is a forward-facing recess 108. It will be noted that each blade installation slot extends into the cylindrical portion 105. It will also be noted that there is a straight-walled valley 109 that has been machined between each adjacent pair of apices. As the trocar tip 102 was shaped like a three-sided pyramid prior to the maching process, each of the V-shaped portions 110 that remain of the pyramid walls lie in a plane. This feature enables the three V-shaped portions 110 of the trocar tip to be manually sharpened on a planar whetting stone without the use of jigs or specialized grinding equipment. As will be subsequently shown and explained, the shoulder 111 formed by the step down from the hour-glass shaped portion 104 to the cylindrical portion 105 will be used as a stop against which an annular blade retaining ring will be tightened. The threaded rear portion 106 is used to secure an arrow shaft to the main body 101.

Figure 2:
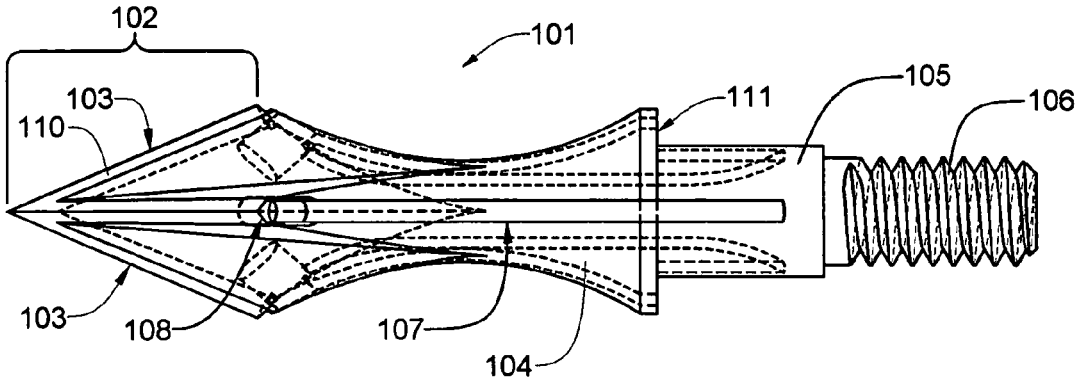
FIG. 2 is a top plan view of the main body of the new tri-blade arrowhead, with hidden features shown using dashed lines.

Referring now to FIG. 2, the various features shown heretofore in FIG. 1 are visible in a somewhat different perspective. With the use of dashed lines to show hidden features, all three blade installation slots 107 are visible, as are all three forward-facing recesses 108. The trocar tip 102, the generally hour-glass shaped portion 104, the cylindrical portion 105, the shoulder 111, and the threaded rear portion 112 are also visible in this view.

Figure 3:
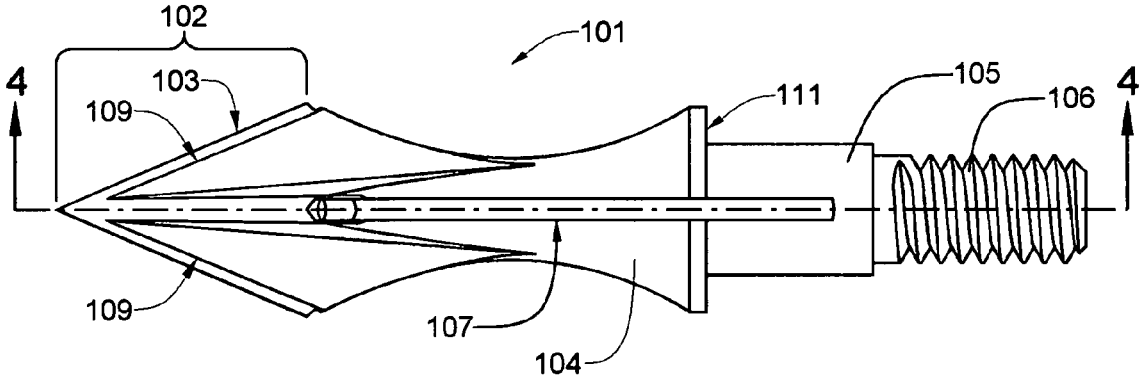
FIG. 3 is a top plan view of the main body of the new tri-blade arrowhead with dashed lines showing hidden features deleted.

Referring now to FIG. 3, the view of FIG. 2 has been simplified by the deletion of the dashed hidden lines. Two of the three straight-walled valleys 109 are readily visible in this view, as is a single blade installation slot 107 and a single forward-facing recess 108.

Figure 4:
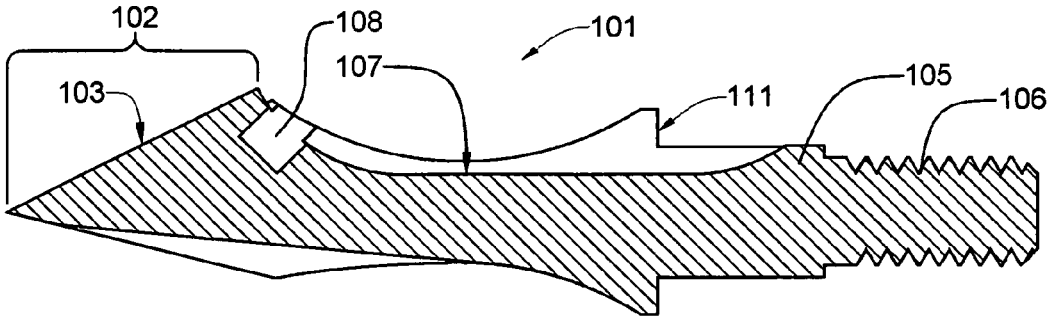
FIG. 4 is a cross-sectional view of the main body of the new tri-blade arrowhead taken through section line 4-4 of FIG. 3.

Referring now to FIG. 4, this cross sectional view, which passes through both the central axis 401 of the main body 101 and one of the sharpened straight edges 103, shows the internal shape of one of the three identical blade installation slots 107 and an associated forward-facing recess 108. It will be noted that the forward-facing recess 108 is directly behind the rearmost point on the sharpened straight edge 103.

Figure 5:
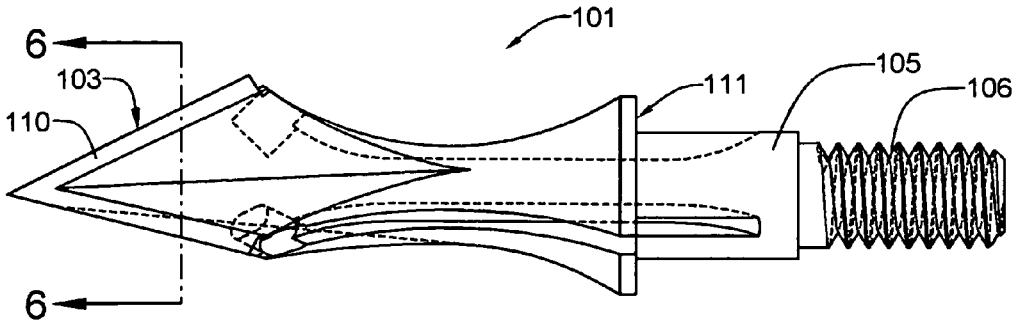
FIG. 5 is a side elevational view of the main body of the new tri-blade arrowhead, with hidden features shown using dashed lines.

Referring now to FIG. 5, in this side view of the main body 101, the viewer is looking over the side of one of the blade installation slots 107, rather than directly into it.

Figure 6:
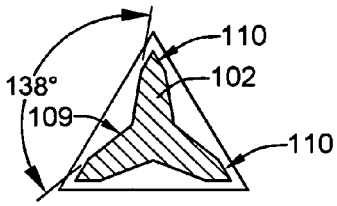
FIG. 6 is a cross-sectional view of the main body of the new tri-blade arrowhead taken through section line 6-6 of FIG. 5, said cross-sectional view being surrounded by an equilateral triangle to show the manually sharpenable configuration thereof.

Referring now to FIG. 6, the preferred angle between the walls of the straight-walled valleys 109 is about 138 degrees. In addition, this cross-sectional view through the trocar tip 102 of the main body 101 clearly shows that each V-shaped portions 110 of the trocar tip 102 lies in a plane. The equilateral triangle 601 which surrounds the cross-sectional view is provided to show this feature. The planarity of each V-shaped portion 110 makes them individually sharpenable on a planar whetting stone.

Figure 7:
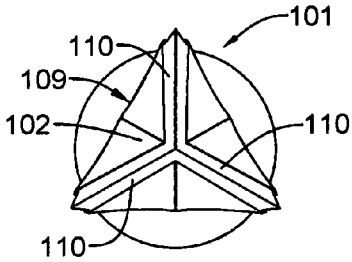
FIG. 7 is a front elevational view of the main body of the new tri-blade arrowhead.

Referring now to FIG. 7, the front view of the main body shows how the straight-walled valleys 109 reduce the frontal area of the trocar tip 102, thereby improving both the aerodynamics of the main body 101 in flight and the penetration of the tip when it impacts a target. Each of the V-shaped portions 110 is visible in this view.

Figure 8:
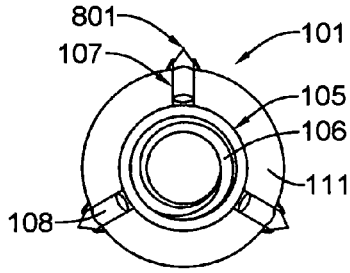
FIG. 8 is a rear elevational view of the main body of the new tri-blade arrowhead.

Referring now to FIG. 8, each of the three forward-facing recesses 108 in the blade installation slots 107 is visible in this view, as are the threaded rear portion 112, the cylindrical portion 105, the shoulder 111, and the rearmost point 801 on each of the sharpened straight edges 103 of the trocar tip 102.

Figure 9:
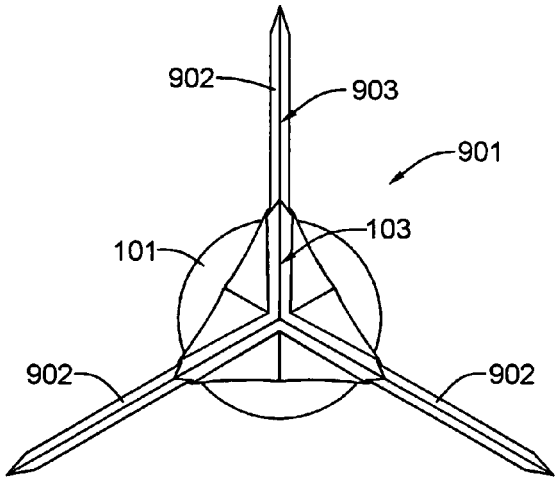
FIG. 9 is a front elevational view of the main body of the new tri-blade arrowhead with the blade set installed therein.

Referring now to FIG. 9, the assembled broadhead 901 is shown head on, with the laminar blades 902 affixed to the main body 101. It can be seen how the sharpened edge 903 of each blade 902 is an extension of an associated sharpened straight edge 103 on the trocar tip 102.

Figure 10:
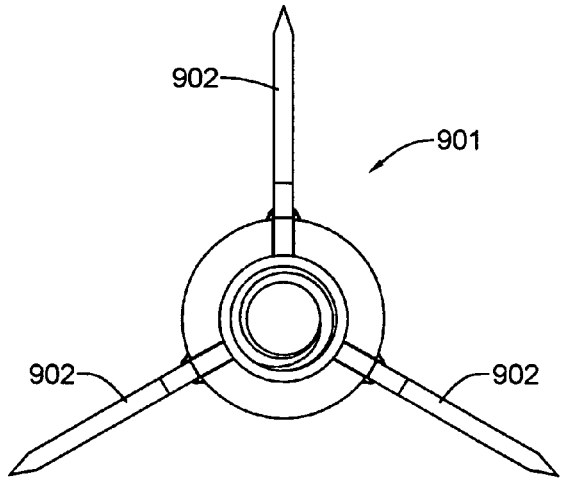
FIG. 10 is a rear elevational view of the main body of the new tri-blade arrowhead with the blade set installed therein.

Referring now to FIG. 10, the rear view of partially-assembled broadhead 901 shows the rearmost sharpened point of each laminar blade 902. An annular blade retaining collar, shown in FIGS. 13 and 14, has not yet been installed.

Figure 11:
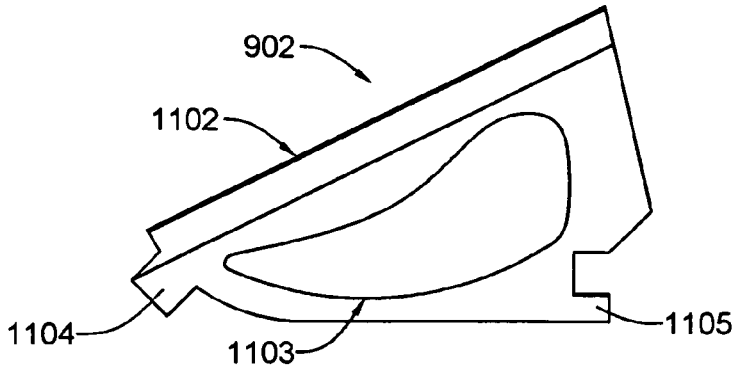
FIG. 11 is a side elevational view of one of the three identical carbon steel blades comprising the blade set.

Referring now to FIG. 11, one of the three identical laminar, preferably carbon steel, laminar blades 902 is shown in a profile side view. The laminar blade 902 incorporates a razor honed, sharpened edge 1102 and a central aperture 1103, which reduces crosswind impact on the broadhead by reducing surface area of the blade 902. An anterior tab 1103, which fits into a forward-facing recess 108, and a posterior extension 1104, which engages the annular blade retaining collar shown in FIGS. 13 and 14, lock the blade within the blade installation slot 107.

Figure 12:
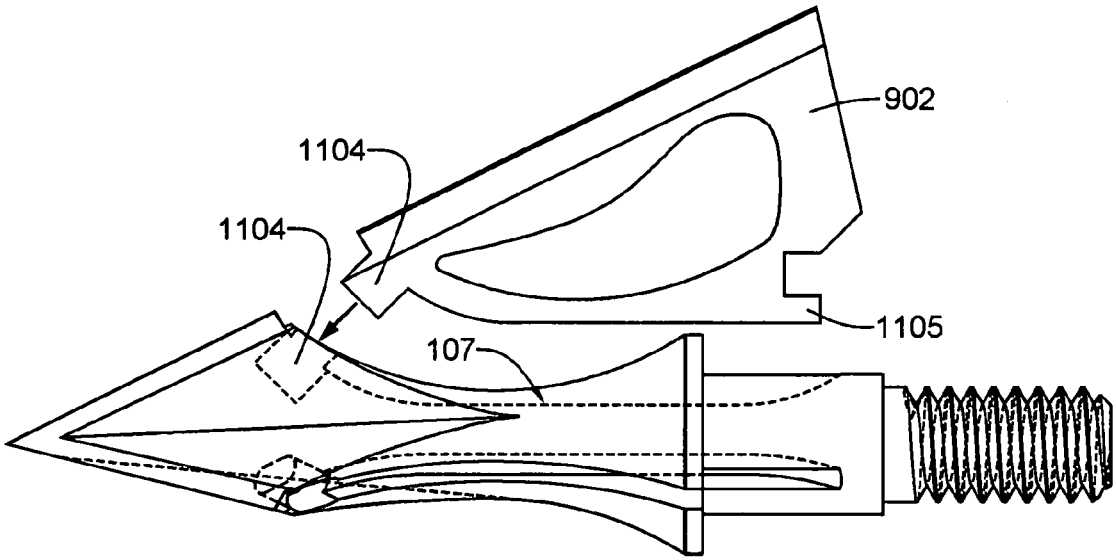
FIG. 12 is a side elevational view of the main body of the new tri-blade arrowhead and one carbon steel blade about to be inserted into one of the three identical blade receiving slot therein.

Referring now to FIG. 12, a laminar blade 902 is shown as it is about to be installed within a blade installation slot 107. The anterior tab 1103 will be inserted within the forward facing recess 108, and the vertical portion of the posterior notch 1104 will be aligned with the sholder 111. In order to completely assemble the broadhead 901, a laminar blade 901 must be installed within each blade installation slot 107.

Figure 13:
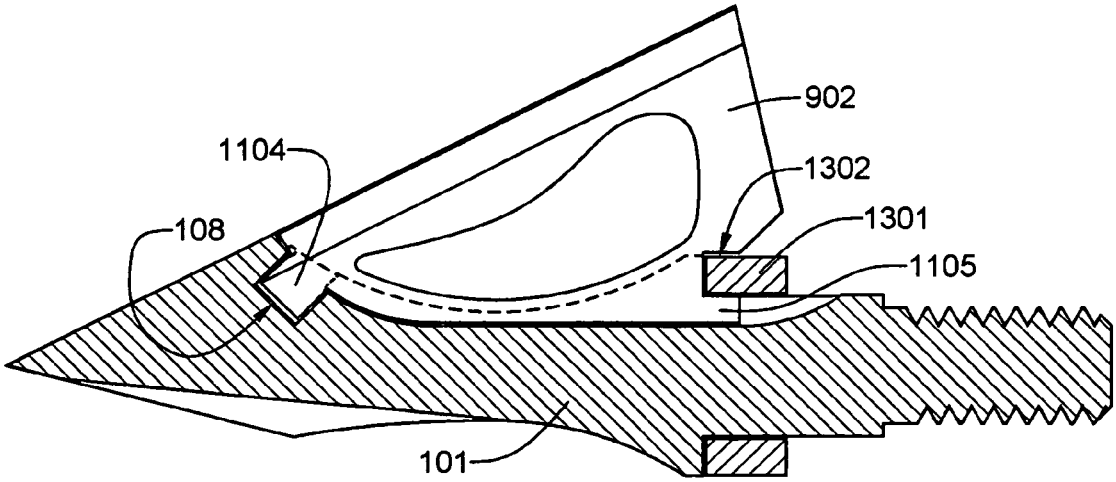
FIG. 13 is the cross-sectional view of the main body, as shown in FIG. 4, with a single carbon steel blade installed therein and held in place with an annular retaining collar.

Referring now to FIG. 13, a laminar blade 902 has been properly positioned within a blade installation slot 107 and an annular blade retaining collar 1301 has been installed over the cylindrical portion 105 of the main body 101. A front portion 1302 of the retaining collar 1301 has engaged the posterior notch 1104 of the laminar blade 902, thereby securing the laminar blade 902 within the blade installation slot 107.

Figure 14:
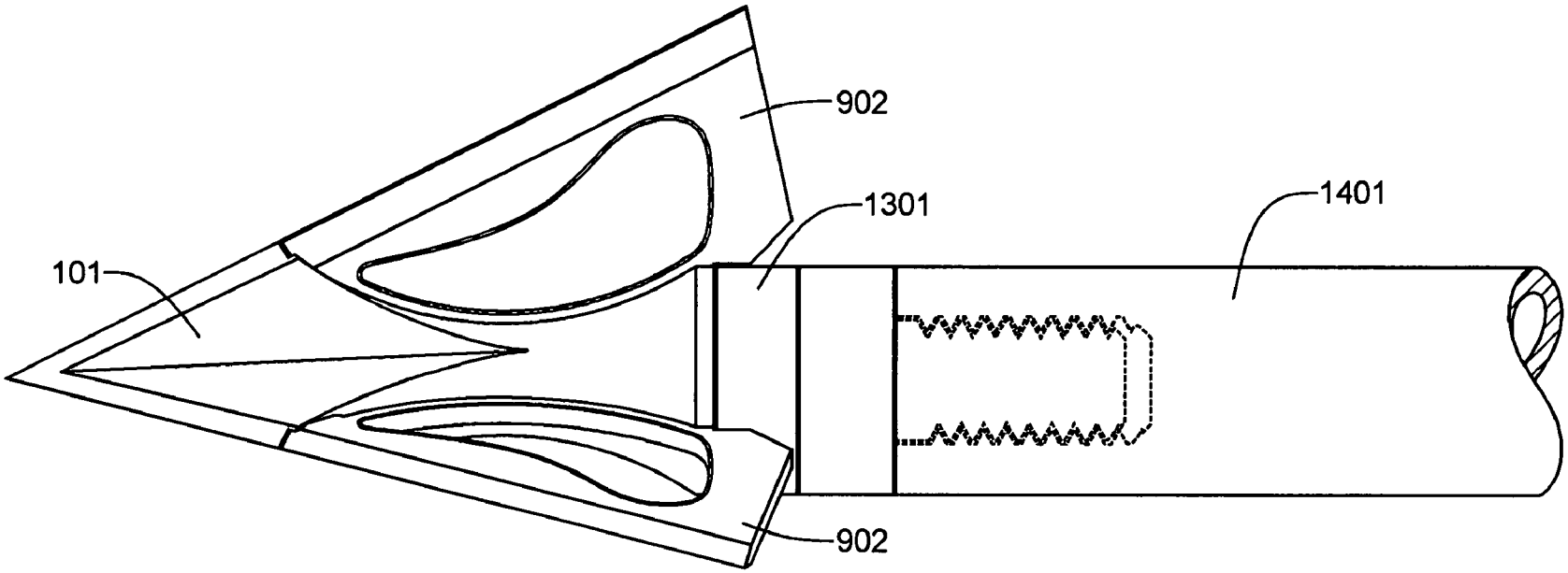
FIG. 14 is an side elevational view of a new fully-assembled tri-blade arrowhead attached to an arrow shaft.

Referring now to FIG. 14, the new broadhead 901 has been installed on an arrow shaft 1401. Two of the three laminar blades 902 are seen in this view.

Although only a single embodiment of the invention has been shown and described, it will be obvious to those having ordinary skill in the art that changes and modifications may be made thereto without departing from the scope and the spirit of the invention as hereinafter claimed.

What is claimed is:

1. An arrow broadhead comprising:

a main body having a three-sided trocar tip, said trocar tip having three sharpened straight edges which intersect at a common vertex; and a plurality of laminar blades mountable on the main body, each laminar blade having a honed edge which is aligned with and forms a generally straight line with one of the sharpened straight edges when the blade is mounted on the main body;

wherein said main body has:

a generally hour-glass-shaped portion continuous with the trocar tip;

a cylindrical portion continuous with said generally hour-glass-shaped portion;

a rearward-facing shoulder formed at the junction of said cylindrical portion and said generally hour-glass-shaped portion;

three blade installation slots, with each slot being aligned with an associated sharpened edge and positioned such that an anterior portion of the slot, which includes a forward-facing recess, is adjacent a rearmost point on the associated sharpened edge, and a posterior portion of the slot extends into the cylindrical portion; and a threaded portion continuous with said cylindrical portion for securing the main body to an arrow shaft.

2. The arrow broadhead of claim 1, wherein each side of the trocar tip is planar and partially cut away, being hollowed with a straight-walled trough.

3. The arrow broadhead of claim 2, wherein the walls of the straight-walled trough intersect an angle of about 138 degrees.

4. The arrow broadhead of claim 1, wherein each pair of sharpened straight edges intersect an angle of about 46 degrees.

5. The arrow broadhead of claim 1, wherein each laminar blade has a central aperture, which reduces cross wind effects on the broadhead when in flight.

6. The arrow broadhead of claim 1, wherein each laminar blade includes an anterior tab that fits into a forward-facing recess, and a posterior extension that fits into the posterior portion of the blade installation slot, and said arrow broadhead further comprises an annular blade retention collar which slides over said cylindrical portion and traps the posterior extension of each laminar blade, said annular blade retention collar being secured in place by an attached arrow shaft.

7. An arrow broadhead connectable to an arrow shaft comprising:

a main body having a tip, said tip having a plurality of sharpened straight edges intersecting at a common vertex, said tip having a plurality of forward facing recesses, each of which is aligned with a straight edge;

a plurality of laminar blades mountable on the main body, each laminar blade having a honed edge which is aligned with and forms a generally straight line with one of the sharpened straight edge when the blade is mounted on the main body, each laminar blade having a forward facing tab that is insertable within a single forward facing recess in the tip; and a retaining collar that fits over a rear portion of each laminar blade, said retaining collar being clamped between said main body and an arrow shaft.

* * * * *